US011715614B2

(12) United States Patent
Hochmuth

(10) Patent No.: US 11,715,614 B2
(45) Date of Patent: Aug. 1, 2023

(54) REMOTE-CONTROLLED MECHANISM, EQUIPMENT ARRANGEMENT HAVING A REMOTE-CONTROLLED MECHANISM, AND METHOD

(71) Applicant: Siemens Aktiengesellschaft, Munich (DE)

(72) Inventor: Thomas Hochmuth, Nittenau (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/575,971

(22) Filed: Jan. 14, 2022

(65) Prior Publication Data

US 2022/0246380 A1 Aug. 4, 2022

(30) Foreign Application Priority Data

Feb. 1, 2021 (DE) ..... 10 2021 200 854.2

(51) Int. Cl.
*H01H 71/70* (2006.01)
*H01H 71/04* (2006.01)
(Continued)

(52) U.S. Cl.
CPC ..... *H01H 71/70* (2013.01); *H01H 71/04* (2013.01); *H01H 9/167* (2013.01);
(Continued)

(58) Field of Classification Search
CPC ..... H01H 9/167; H01H 71/04; H01H 71/70; H01H 2071/042; H01H 2071/048; H01H 2071/665
(Continued)

(56) References Cited

U.S. PATENT DOCUMENTS 6,522,227 B1 * 2/2003 Mody ..... H01H 71/70 335/14
2005/0001700 A1 * 1/2005 Lewis ..... H01H 71/70 335/14

FOREIGN PATENT DOCUMENTS

DE 10 2018 209 591 A1 12/2019
DE 102018209591 A1 * 12/2019
(Continued)

OTHER PUBLICATIONS

Machine translation of Ascari et al. European Patent Document EP 1870919 A1 Dec. 26, 2007 (Year: 2007).*
(Continued)

*Primary Examiner* — Kevin J Comber
(74) *Attorney, Agent, or Firm* — Harness, Dickey & Pierce, P.L.C.

(57) ABSTRACT

A remote-controlled mechanism according to an embodiment is used for coupling to a protective switching device to use a controllable drive device of the remote-controlled mechanism to actuate the coupled protective switching device. To this end, the remote-controlled mechanism includes: an actuating element operatively connectable to an actuating element of the coupled protective switching device and actuatable either by a remotely controllable drive device of the remote-controlled mechanism or manually; one or more sensor devices for capturing position data relating to a position of the actuating element of the remote-controlled mechanism; and a controller for evaluating the captured position data and for controlling the drive device via control commands. The controller is designed to disable the drive device upon an evaluation of the position data and/or of the control commands revealing that the actuating element of the remote-controlled mechanism has been switched off manually.

17 Claims, 7 Drawing Sheets

(51) Int. Cl.
*H01H 71/66* (2006.01)
*H01H 9/16* (2006.01)

(52) U.S. Cl.
CPC . *H01H 2071/042* (2013.01); *H01H 2071/048* (2013.01); *H01H 2071/665* (2013.01)

(58) Field of Classification Search
USPC ..... 361/114
See application file for complete search history.

(56) References Cited

FOREIGN PATENT DOCUMENTS

EP 1 870 919 A1 12/2007
EP 1870919 A1 * 12/2007 ..... H01H 71/70

OTHER PUBLICATIONS

Machine translation of Faltermeier et al. German Patent Document DE 102018209591 A1 Dec. 19, 2019 (Year: 2019).*
German Office Action dated Dec. 10, 2021.

* cited by examiner

REMOTE-CONTROLLED MECHANISM, EQUIPMENT ARRANGEMENT HAVING A REMOTE-CONTROLLED MECHANISM, AND METHOD

PRIORITY STATEMENT

The present application hereby claims priority under 35 U.S.C. § 119 to German patent application number DE 102021200854.2 filed Feb. 1, 2021, the entire contents of which are hereby incorporated herein by reference.

FIELD

Example embodiments of the invention generally relate to a remote-controlled mechanism for coupling to a protective switching device in order to use a controllable drive device of the remote-controlled mechanism to actuate the coupled protective switching device. Furthermore, embodiments of the invention generally relate to an equipment arrangement comprising a remote-controlled mechanism and a protective switching device coupled thereto; and to a method for switching on a protective switching device coupled to the remote-controlled mechanism.

BACKGROUND

A remote-controlled mechanism is used to switch a protective switching device, in particular a low-voltage protective switching device, on and off remotely. Favored applications for remote-controlled mechanisms are commercial units that are physically extensive or not constantly occupied, such as e.g. purification plants or radio stations, and automated installations for energy and facilities management.

The use of the remote-controlled mechanism permits the user to directly and immediately access the installation even at remote or hard-to-reach locations. In particular switching on again quickly after an error provides a considerable saving in terms of time and cost. Possible protective switching devices that can be actuated by a remote-controlled mechanism are for example miniature circuit breakers (MCB), residual current operated circuit breakers (RCCB), arc fault detection devices, combination devices such as residual current operated circuit breakers with overcurrent protection (RCBO) or switch disconnectors.

The prior art, for example German laid-open specification DE 10 2018 209 591 A1 (Siemens AG), Dec. 19, 2019, discloses remote-controlled mechanisms that are in the form of a separate device with an individual housing. Remote-controlled mechanisms such as these are arranged beside a protective switching device that can be actuated by the remote-controlled mechanism, e.g. on a top-hat rail in an electrical distributor, and are coupled to the protective switching device by a switching mechanism, e.g. using a handle connector that couples an actuating element of the remote-controlled mechanism to an actuating element of the protective switching device. An equipment arrangement comprising a remote-controlled mechanism such as this and a protective switching device coupled thereto can be actuated by an operator manually in situ using the handle connector (manual actuation) or by an operator remotely using a tripping signal transmitted to the remote-controlled mechanism via a signal line or wirelessly (remote actuation). Siemens AG offers remote-controlled mechanisms such as these e.g. in the 5ST305x range. A protective switching device coupled by a switching mechanism to a remote-controlled mechanism that is in the form of a separate device with an individual housing is also referred to simply as an attachment below.

SUMMARY

The inventors have discovered that in order to prevent a risk to people, a remote-controlled mechanism together with its attachment should not be able to be switched on remotely after the attachment has been switched off manually, e.g. in the event of disconnection for maintenance work. On the other hand, such blocking of remote actuation after a manual breaking operation, in particular in the case of remote-controlled mechanisms that are arranged at relatively hard-to-reach locations such as e.g. on offshore wind farms, can give rise to high levels of complexity, since it is recurrently the case that a remote-controlled mechanism cannot distinguish a breaking operation that has taken place automatically, e.g. by way of an attached shunt release, undervoltage release or overvoltage release, from a manual breaking operation.

The inventors have discovered that such situations and applications have not been taken into account at all, or have not been taken into account to a satisfactory extent, to date in the case of remote-controlled mechanisms that are in the form of a separate device with an individual housing.

Embodiments of the present invention provide a remote-controlled mechanism, an equipment arrangement comprising a remote-controlled mechanism and a protective switching device coupled thereto, and a method for switching on the protective switching device again that overcomes the disadvantages cited above.

The remote-controlled mechanism according to an embodiment of the invention is configured for coupling to a protective switching device in order to use the remote-controlled mechanism to actuate the coupled protective switching device. The protective switching device is preferably a low-voltage protective switching device, the term "low-voltage" denoting a voltage of up to 1000 V AC and 1500 V DC.

The method according to according to an embodiment of the invention is used for switching on a protective switching device coupled to a remote-controlled mechanism. The remote-controlled mechanism has an actuating element that is operatively connected to an actuating element of the protective switching device, the latter actuating element being able to be actuated in order to switch on the protective switching device.

An embodiment is also directed to a computer program product according to an embodiment of the invention. The computer program product is designed to be executable in a control unit. The computer program product can be storable as software or firmware in a memory device and designed to be executable by an arithmetic and logic unit, e.g. a processor of a control unit.

Alternatively or additionally, at least part of the computer program product can also be in the form of a hardwired circuit, for example in the form of an ASIC. The computer program product is designed to receive and evaluate sensor values and to generate commands for components of a drive device.

According to an embodiment of the invention, the computer program product is designed to implement and perform at least one embodiment of the outlined method. The computer program product can bring together all of the subfunctions of the method, that is to say can be in monolithic form. Alternatively, the computer program product can also be in segmented form and distribute respective subfunctions over segments that are executed on separate hardware. By way of example, one part of the method can be performed in a remote-controlled mechanism and another part of the method can be performed in a higher-level control unit, such as for example a PLC, a manual parameterization device or a computer cloud.

Further, in an embodiment, a computer program product is proposed that can be loaded directly into the internal memory of a digital computing unit and comprises software code sections that can be used to carry out the steps of the method described herein when the product runs on the computing unit. The computing unit is in particular a computing unit for controlling a drive device in a remote-controlled mechanism according to an embodiment of the invention. The computer program product can be stored on a data carrier, such as e.g. a USB memory stick, a DVD or a CD-ROM, a flash memory, EEPROM or an SD card. The computer program product can also be available in the form of a signal that is loadable via a wired or wireless network.

The method is preferably realized in the form of a computer program in order to be carried out automatically. An embodiment of the invention is thus firstly also a computer program containing program code instructions executable by a computer and secondly a storage medium containing such a computer program, that is to say a computer program product containing program code segments, and finally also an energy source or a tertiary control unit, into the memory of which such a computer program has been loaded or is loadable as code for performing the method and its configurations.

An embodiment of the invention is directed to a remote-controlled mechanism for coupling to a protective switching device to use the remote-controlled mechanism to actuate the coupled protective switching device, the remote-controlled mechanism comprising:

an actuating element, operatively connectable to an actuating element of the coupled protective switching device, manually actuatable or actuatable by a remotely controllable drive device of the remote-controlled mechanism;

one or more sensor devices to capture position data relating to a position of the actuating element of the remote-controlled mechanism; and a controller to evaluate the position data captured and to control the remotely controllable drive device via control commands;

wherein the control unit is designed to disable the remotely controllable drive device upon an evaluation of at least one of the position data and the control commands revealing that the actuating element of the remote-controlled mechanism has been manually switched off.

An embodiment of the invention is directed to a method for switching on a protective switching device coupled to a remote-controlled mechanism, the remote-controlled mechanism including an actuating element operatively connected to an actuating element of the protective switching device, the actuating element of the protective switching device being actuatable to switch on the protective switching device and being manually actuatable or actuatable by a remotely controllable drive device of the remote-controlled mechanism, the method comprising:

disabling the remotely controllable drive device upon an evaluation of at least one of position data, describing a position of the actuating element of the remote-controlled mechanism, and control commands relating to operation of the remotely controllable drive device revealing that the actuating element of the remote-controlled mechanism has been manually switched off.

An embodiment of the invention is directed to a non-transitory computer program product storing software code sections, directly loadable into an internal memory of a digital, to carry out the method of claim 9 when the software code sections run on the computer.

BRIEF DESCRIPTION OF THE DRAWINGS

An example embodiment of the remote-controlled mechanism, the arrangement comprising a remote-controlled mechanism and a protective switching device coupled thereto, and the method for switching on the protective switching device again is explained more thoroughly below with reference to the accompanying figures, in which.

In the various figures of the drawing, identical parts are always provided with the same reference signs. The description applies to all figures of the drawing in which the relevant part can also be seen.

DETAILED DESCRIPTION OF THE EXAMPLE EMBODIMENTS

Figure 1:
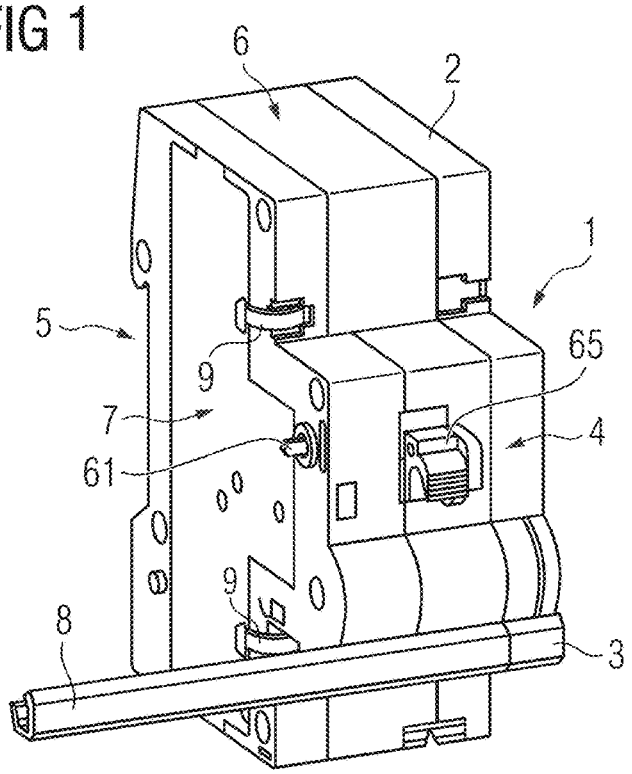
FIG. 1 shows a schematic depiction of a remote-controlled mechanism in a perspective view.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. At least one embodiment of the present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

The remote-controlled mechanism according to an embodiment of the invention is configured for coupling to a protective switching device in order to use the remote-controlled mechanism to actuate the coupled protective switching device. The protective switching device is preferably a low-voltage protective switching device, the term "low-voltage" denoting a voltage of up to 1000 V AC and 1500 V DC.

The remote-controlled mechanism according to an embodiment of the invention is used for switching the protective switching device on and off remotely (remote actuation, remote control, RC for short); this is done by transmitting to the remote-controlled mechanism an applicable signal from a higher-level unit of the remote-controlled mechanism. The signal transmitted to the remote-controlled mechanism is a tripping signal that triggers a switching process of the actuating element of the remote-controlled mechanism. The higher-level unit of the remote-controlled mechanism is a communication partner of the remote-controlled mechanism that is authorized for remote control of the remote-controlled mechanism, e.g. a computer of an operator in situ or of a higher-level unit, for example a control center or control room, a parameterization device or a computer cloud. The tripping signal can be transmitted by wire or wirelessly. The remote-controlled mechanism has appropriate communication interfaces for this purpose.

Alternatively, the remote-controlled mechanism according to an embodiment and hence the protective switching device coupled to the remote-controlled mechanism can be actuated, i.e. switched on or off, by an operator manually in situ (manual actuation).

The remote-controlled mechanism according to an embodiment has an actuating element that is operatively connected to an actuating element of the coupled protective switching device. The actuating element of the remote-controlled mechanism can be actuated either by a remotely controllable drive device of the remote-controlled mechanism, which is activated based upon a tripping signal received by the remote-controlled mechanism, or manually.

The remote-controlled mechanism according to an embodiment has one or more sensor devices for capturing position data relating to a position of the actuating element of the remote-controlled mechanism. The remote-controlled mechanism has a control unit for evaluating the captured position data and for controlling the drive device via control commands. The control unit is designed to disable the drive device if an evaluation of the position data and/or of the control commands reveals that the actuating element of the remote-controlled mechanism has been switched off manually.

The method according to according to an embodiment of the invention is used for switching on a protective switching device coupled to a remote-controlled mechanism. The remote-controlled mechanism has an actuating element that is operatively connected to an actuating element of the protective switching device, the latter actuating element being able to be actuated in order to switch on the protective switching device.

The actuating element of the remote-controlled mechanism and the actuating element of the protective switching device can each be switched between two switching positions, On and Off. In the case of the operative connection that is present here, the two actuating elements are connected to one another, e.g. mechanically by a handle bridge, in such a way that both actuating elements adopt the same switching position: a) if the actuating element of the remote-controlled mechanism is in the "On" switching position, then the actuating element of the protective switching device is too, and vice versa; b) if the actuating element of the remote-controlled mechanism is in the "Off" switching position, then the actuating element of the protective switching device is too, and vice versa. If the protective switching device trips automatically in a trip situation, e.g. after a grid fault such as an overcurrent, i.e. the actuating element of the protective switching device automatically changes from the "On" switching position to the "Off" switching position, the operative connection between the actuating elements of the remote-controlled mechanism and the protective switching device means that the actuating element of the remote-controlled mechanism also changes from the "On" switching position to the "Off" switching position.

The remote-controlled mechanism can be put into the second switching position "On" or "Off" from a first switching position "Off" or "On" by virtue of a) the remote-controlled mechanism receiving an applicable switching signal from a higher-level unit of the remote-controlled mechanism, or by virtue of b) an operator actuating the actuating element of the remote-controlled mechanism manually in situ, i.e. manually changing the switching position of the actuating element of the remote-controlled mechanism. The switching signal prompts the drive device to change the switching position of the actuating element of the remote-controlled mechanism; this is referred to as remote actuation, remote control or remote switching.

According to an embodiment of the invention, the drive device is disabled, i.e. remote switching of the actuating element of the remote-controlled mechanism is prevented, if an evaluation of position data that describe a position of the actuating element of the remote-controlled mechanism and/or of control commands that have been sent to the drive device reveals that the actuating element of the remote-controlled mechanism has been switched off manually. In this case, remote actuation is thus disabled—the actuating element of the remote-controlled mechanism can be put into the "On" switching position again only via manual actuation, that is to say manually; for this reason, the disablement of remotely actuated switching on of the drive device after the remote-controlled mechanism has been switched off manually is referred to as a "manual-on" function.

The remote-controlled mechanism comprises one or more sensors that monitor the position of the actuating element of the remote-controlled mechanism. A sensor registers at least one change in a position or switching position of the actuating element of the remote-controlled mechanism, e.g. a change from a first switching position to a second switching position, and vice versa. These measured values can be stored in the remote-controlled mechanism, in particular a memory unit of the remote-controlled mechanism, together with a related time value as position data. By evaluating a time series of the position data, it is possible to examine switching positions of the actuating element in the past. Position data can thus be taken as a basis for e.g. verifying that the control element of the remote-controlled mechanism is in the "Off" position.

Operation of the drive device, e.g. a rotation of an electric motor of the drive device, is controlled by control commands that e.g. are output by a control unit of the remote-controlled mechanism. The control unit can e.g. transmit a control command to an electrical switch, e.g. a semiconductor switch, which prompts the switch to change from an off state to an on state, allowing a flow of current to an electric motor of the drive device; the control command can be in the form of a voltage change, generated by the control unit, on a gate electrode of a transistor that turns on the transistor. These control commands can be stored in the remote-controlled mechanism, in particular a memory unit of the remote-controlled mechanism, together with a related time value. By evaluating a time series of switching commands, it is possible to examine operating times of the drive device in the past. Switching commands can thus be taken as a basis for e.g. verifying that the drive device was not in operation during the movement of the control element of the remote-controlled mechanism to the Off position.

At least one embodiment of the invention is based on the insight that safety in regard to a protective switching device is increased if, after the protective switching device has been switched off by a first operator manually in situ, remote actuation of the protective switching device by a second operator, who knows nothing about the activity of the first operator, e.g. maintenance or fault locating, using a remote-controlled mechanism is prevented. Such disablement of remote actuation of the protective switching device takes effect only after manual shutdown of a protective switching device; remote actuation of the protective switching device is not disabled after a protective switching device has been shut down on account of overload, short circuit or fault current.

As soon as an equipment arrangement, comprising a remote-controlled mechanism and a protective switching device, has been switched off manually, e.g. by actuating a handle bridge that couples the actuating elements of the equipment arrangement, e.g. in order to disconnect it for the purpose of maintenance or repair work, it is not possible to switch on the equipment arrangement remotely by "remote" command for a drive arrangement of the remote-controlled mechanism. It is first necessary to switch on the equipment arrangement manually, e.g. by actuating the handle bridge (so-called "manual-on"). Only then is it possible to switch on the equipment arrangement remotely via a "remote" command for a drive arrangement of the remote-controlled mechanism (remote actuation).

Advantageous configurations and developments of the invention are specified in the claims. The method according to an embodiment of the invention can also be developed in accordance with the device claims, and vice versa.

An embodiment is also directed to a computer program product according to an embodiment of the invention. The computer program product is designed to be executable in a control unit. The computer program product can be storable as software or firmware in a memory device and designed to be executable by an arithmetic and logic unit, e.g. a processor of a control unit.

Alternatively or additionally, at least part of the computer program product can also be in the form of a hardwired circuit, for example in the form of an ASIC. The computer program product is designed to receive and evaluate sensor values and to generate commands for components of a drive device.

According to an embodiment of the invention, the computer program product is designed to implement and perform at least one embodiment of the outlined method. The computer program product can bring together all of the subfunctions of the method, that is to say can be in monolithic form. Alternatively, the computer program product can also be in segmented form and distribute respective subfunctions over segments that are executed on separate hardware. By way of example, one part of the method can be performed in a remote-controlled mechanism and another part of the method can be performed in a higher-level control unit, such as for example a PLC, a manual parameterization device or a computer cloud.

Further, in an embodiment, a computer program product is proposed that can be loaded directly into the internal memory of a digital computing unit and comprises software code sections that can be used to carry out the steps of the method described herein when the product runs on the computing unit. The computing unit is in particular a computing unit for controlling a drive device in a remote-controlled mechanism according to an embodiment of the invention. The computer program product can be stored on a data carrier, such as e.g. a USB memory stick, a DVD or a CD-ROM, a flash memory, EEPROM or an SD card. The computer program product can also be available in the form of a signal that is loadable via a wired or wireless network.

The method is preferably realized in the form of a computer program in order to be carried out automatically. An embodiment of the invention is thus firstly also a computer program containing program code instructions executable by a computer and secondly a storage medium containing such a computer program, that is to say a computer program product containing program code segments, and finally also an energy source or a tertiary control unit, into the memory of which such a computer program has been loaded or is loadable as code for performing the method and its configurations.

When the text below describes method steps or method step sequences, this relates to actions that take place based upon the computer program or under the control of the computer program, unless it is expressly indicated that individual actions are prompted by a user of the computer program. At a minimum, any use of the term "automatic"

means that the relevant action takes place based upon the computer program or under the control of the computer program.

Instead of a computer program containing individual program code instructions, the method described here and below can also be implemented in the form of firmware. It is clear to a person skilled in the art that instead of a method being implemented in software, it is always also possible for it to be implemented in firmware or in firmware and software or in firmware and hardware. For the description presented here, therefore, the term software or the term computer program is also intended to cover other implementation options, namely in particular an implementation in firmware or in firmware and software or in firmware and hardware.

According to one preferred configuration of an embodiment of the invention, the control unit is designed to cancel a disablement of the drive device for a definable period of time after the control unit has received an accordingly defined signal from a higher-level unit of the remote-controlled mechanism. According to one preferred configuration of the invention, a disablement of the drive device is cancelled for a definable period of time after the remote-controlled mechanism has received an applicable signal from a higher-level unit of the remote-controlled mechanism. This cancelation of a disablement of the drive device for a definable period of time, which cancelation can be initiated by a higher-level unit of the remote-controlled mechanism, is referred to as a reset function.

The advantage of this temporary suspension of the "manual-on" function by an operator is that there may be instances of application in which the remote-controlled mechanism erroneously regards an automatic breaking operation on the system, e.g. by an attached supplementary device, e.g. a shunt release, an undervoltage or overvoltage release, an auxiliary circuit switch or an error signal switch, as a manual breaking operation. Such equipment errors arise in particular if the remote-controlled mechanism has not just a protective switching device but also a supplementary device coupled to it. The supplementary device can be coupled to a first wide side of the remote-controlled mechanism, the second wide side of which, which is opposite the first wide side, has the protective switching device coupled to it, and can trip the protective switching device by way of a driver, which is extended by a shaft through the remote-controlled mechanism to the latching mechanism shaft of the protective switching device. If such an error occurs in an equipment arrangement installed at a location that is remote or accessible only with considerable effort, e.g. on a wind farm or in an offshore installation, an operator would need to be in situ for an active "manual-on" function in order to be able to switch on the system again manually. It is therefore advantageous if the active "manual-on" function can be temporarily switched off by a reset function of the manual-on function, e.g. by pushing, in a manner predefinable by the operator, e.g. with a required push time of longer than 5 s, which makes random and unintentional actuation impossible, a remote-actuation pushbutton switch accessible to the remote operator, as a result of which a reset signal is transmitted from the remote-actuation pushbutton switch to the remote-controlled mechanism. This reset signal starts the reset function of the manual-on function in the remote-controlled mechanism, the reset function being active for a certain time interval, the length of which, e.g. 90 s or 120 s, can be set by the operator. During this time interval, the equipment arrangement, comprising the protective switching device and the remote-controlled mechanism, can be switched on remotely (remote actuation), e.g. by pushing a remote pushbutton switch, without the need for manual actuation of the remote-controlled mechanism. After the reset time interval has elapsed, the equipment arrangement reverts to the "manual-on" function if there has been no remote actuation during the active reset function. The possibility of resetting the "manual-on" function remotely (reset function) also results in no risk to operational safety if a breaking operation on the equipment arrangement comprising the remote-controlled mechanism and the protective switching device may have been incorrectly identified as a manual breaking operation.

According to one preferred configuration of an embodiment of the invention, the drive device is disabled after a reset has been performed for the remote-controlled mechanism that puts the remote-controlled mechanism into a defined initial state. It is possible for the reset to put a control unit of the remote-controlled mechanism, which control unit is designed to evaluate the captured position data and to control the drive device via control commands, into a defined initial state. It is possible for the reset to put software that controls the function of the control unit into a defined initial state; the software can also be realized as firmware in this case. In the case of the Siemens 5ST305x range, the reset is triggered as a result of a mode selector switch, also referred to as a selection or reset slider, being switched or moved to an "RC OFF" position. The mode selector switch can adopt three positions:

"OFF" position: the remote-controlled mechanism is switched off, mechanically locked and can be sealed and/or closed off.

"RC OFF" position: only manual actuation of the remote-controlled mechanism is possible, and the software of the remote-controlled mechanism is reset.

"RC ON" position: both manual and remote actuation of the remote-controlled mechanism are possible.

Two examples in which a reset is performed for the remote-controlled mechanism are explained below:

Example 1: if an equipment arrangement, comprising a protective switching device and the remote-controlled mechanism, is switched off by the tripping protective switching device, e.g. in the event of a short circuit, an overcurrent or a fault current, or if an equipment arrangement, comprising a protective switching device, the remote-controlled mechanism and a supplementary device attached to the remote-controlled mechanism, such as an overvoltage or shunt release, is switched off, then the remote-controlled mechanism changes to a "tripped" state, which is signaled by a red flashing from an operating state indicator. After the mode selector switch has been switched to the "RC OFF" position (=remote-controlled mechanism reset), this "tripped" state is cleared, the remote-controlled mechanism changes to the initial state, which is signaled by a slow green flashing from an operating state indicator, and the remote-controlled mechanism requires a manual closing operation.

Example 2: if the driver of a protective switching device or of a supplementary device attached to the remote-controlled mechanism reacts erroneously, the remote-controlled mechanism changes to the "error condition" state, which is signaled by a solid red light from an operating state indicator, and the remote-controlled mechanism can no longer be actuated remotely. After the mode selector switch has been switched to the "RC OFF" position (=remote-controlled mechanism reset), this "error condition" state is cleared, the remote-controlled mechanism changes to the initial state, which is signaled by a slow green flashing from an operating state indicator, and the remote-controlled mechanism requires a manual closing operation if the equipment arrangement was in the OFF position. If the equipment arrangement was in the ON position, the remote-controlled mechanism again becomes green and operational.

After a reset for the remote-controlled mechanism, it is not possible to switch on the equipment arrangement remotely by "remote" command for a drive arrangement of the remote-controlled mechanism. It is first necessary for the equipment arrangement to be switched on manually, e.g. by actuating the handle bridge (a so-called "manual on"). Only then is it again possible to switch on the equipment arrangement remotely via a "remote" command for a drive arrangement of the remote-controlled mechanism (remote actuation). This prevents the equipment arrangement from being unintentionally switched on remotely after a reset for the remote-controlled mechanism, e.g. as a result of the mode selector switch being switched to the "RC OFF" position.

According to one preferred configuration of an embodiment of the invention, the drive device is disabled if the remote-controlled mechanism is put into operation by applying a supply voltage. As soon as the remote-controlled mechanism in an equipment arrangement, comprising a remote-controlled mechanism and a protective switching device, is put into operation (application of the supply voltage), it is not possible to switch on the equipment arrangement remotely by "remote" command for a drive arrangement of the remote-controlled mechanism. It is first necessary to switch on the equipment arrangement manually, e.g. by actuating the handle bridge (a so-called "manual-on"). Only then is it possible to switch on the equipment arrangement remotely via a "remote" command for a drive arrangement of the remote-controlled mechanism (remote actuation). This prevents the equipment arrangement from being unintentionally switched on remotely after the remote-controlled mechanism has been put into operation again (application of the supply voltage).

According to one preferred configuration of an embodiment of the invention, the remote-controlled mechanism comprises a sensor device for sensing a movement of the drive device. In this regard, the inside of the remote-controlled mechanism has a control unit that can monitor the movements of the actuating element and, according to a more preferred configuration, also the movement of a driving shaft (latching mechanism of the protective switching device)—the remote-controlled mechanism is therefore able to distinguish a manual breaking operation (manual actuation) from a breaking operation by way of the motor drive (remote actuation). This monitoring takes place by way of sensors that deliver their sensor signals to the control unit, where they are evaluated. It is possible for the sensor arrangement to have one or more permanent magnets that are fitted to the actuating element of the remote-controlled mechanism and possibly to the driver inside the remote-controlled mechanism and the movement of which is detected via magnet sensors, e.g. Hall sensors.

According to one preferred configuration of an embodiment of the invention, the remote-controlled mechanism comprises a driving shaft for mechanically transmitting a tripping movement. This tripping movement can take place, e.g. via the driving shaft of the remote-controlled mechanism, from a supplementary device coupled to the remote-controlled mechanism to a protective switching device coupled to the remote-controlled mechanism. The remote-controlled mechanism comprises a sensor device for sensing a movement of the driving shaft.

According to one preferred configuration of an embodiment of the invention, the remote-controlled mechanism comprises a voltage sensor for measuring the level of a supply voltage of the remote-controlled mechanism. Since a supply voltage is applied to the remote-controlled mechanism when the remote-controlled mechanism is put into operation, the control unit can thus tell from a characteristic response of the supply voltage, e.g. a rise from a low voltage value in the region of 0 V to an operating value of e.g. 24 V, that the remote-controlled mechanism is being put into operation (application of the supply voltage).

One preferred configuration of an embodiment of the invention is an equipment arrangement, comprising a remote-controlled mechanism according to this description and a protective switching device coupled to the remote-controlled mechanism. The protective switching device can be in the form of a miniature circuit breaker or in the form of a residual current operated circuit breaker or in the form of a combination device having the functions of a miniature circuit breaker and a residual current operated circuit breaker.

According to one preferred configuration of an embodiment of the invention, the equipment arrangement comprises a supplementary device coupled to the remote-controlled mechanism, wherein the remote-controlled mechanism comprises a driving shaft designed to transmit a tripping movement initiated by the supplementary device to the protective switching device mechanically.

According to one preferred configuration of an embodiment of the invention, the remote-controlled mechanism comprises a communication interface for communicating with a coupled protective switching device and/or with a higher-level unit. The communication interface can be in wired or wireless form.

According to one preferred configuration of an embodiment of the invention, the remote-controlled mechanism comprises one or more sensor devices, wherein at least one of the one or more sensor devices comprises a magnet sensor that interacts with a permanent magnet that can be moved with the actuating element. The advantage of this is that magnet sensors interacting with permanent magnets are inexpensive and reliable.

According to one preferred configuration of an embodiment of the invention, the remote-controlled mechanism comprises a housing that can be coupled to a housing of a protective switching device. The advantage of this is that the remote-controlled mechanism can be coupled to different protective switching devices as a separate unit, in contrast to an embodiment in which the remote-controlled mechanism is integrated in the housing of a protective switching device.

According to one preferred configuration of an embodiment of the invention, the remote-controlled mechanism comprises a printed circuit board on which the control unit and a memory device are arranged. The advantage of this is that the electronics can be accommodated in the housing of the remote-controlled mechanism to save space.

According to one preferred configuration of an embodiment of the invention, the method involves performing a check to determine whether the equipment arrangement, comprising a remote-controlled mechanism and a protective switching device, has been put into the switched-off state by an operator manually in situ (so-called "manual-off"):

a) The signals from the sensors indicate that the actuating element of the remote-controlled mechanism is in the Off position.
b) There is no indication in the memory device that the drive device was in operation during the movement of the actuating element of the remote-controlled mechanism to the Off position: there is no actuation command for the motor, nor has a sensor detected a rotation of the drive device.

c) There is no indication in the memory device that a rotation of the driving shaft of the remote-controlled mechanism has occurred, brought about by a breaking operation on the protective switching device that was triggered by a supplementary device, during the movement of the actuating element to the Off position. No sensor has detected a rotation of the driving shaft.

The result of steps a) to c): the equipment arrangement must therefore have been put into the switched-off state by an operator manually in situ.

According to one preferred configuration of an embodiment of the invention, the method involves performing a check to determine whether a mode selector switch of the remote-controlled mechanism is in a locked position, in which it prevents actuation of the actuating element: a sensor detects the position of the mode selector switch: the mode selector switch is either in the locked position or the mode selector switch is not in the locked position.

According to one preferred configuration of an embodiment of the invention, the method involves performing a check to determine whether the remote-controlled mechanism has been put into operation again:

a) The characteristic of the supply voltage on the remote-controlled mechanism is measured using a voltage sensor.

b) The trend in the measured values over time is stored in the memory device.

c) If the control unit detects a rise in the supply voltage from a value in the region of 0 V to a present voltage level, the remote-controlled mechanism has been put into operation again.

According to one preferred configuration of an embodiment of the invention, the method involves performing a check to determine whether the remote-controlled mechanism is coupled to a 1-, 2-, 3- or 4-pole protective switching device or to an n-pole protective switching device ($n \in N$ with $n \geq 5$): the signals from the sensors indicate how quickly a gear wheel of the drive device and/or the actuating element of the remote-controlled mechanism accelerate from rest; the more pole switches need to be actuated, the lower the acceleration. A multi-pole protective switching device with high applied force can require high acceleration, whereas a 1-pole device with low applied force can require deceleration by the drive device. This information, the acceleration value, can be used to set the acceleration of the drive device exactly. The precise association between the number of pole switches and the corresponding acceleration can be stored in the memory device.

According to one preferred configuration of an embodiment of the invention, the method involves performing a check to determine whether the equipment arrangement, comprising a remote-controlled mechanism and a protective switching device, has been put into the switched-on state by an operator manually in situ (so-called "manual-on"): after the drive device was blocked for remote-on signals, which are supposed to trigger remote actuation of the remote-controlled mechanism, in the three cases cited above (manual-off; mode selector switch actuated; operation started), a check is performed to determine whether the signals from the sensors indicate that the actuating element is in the "On" switching position.

FIG. 1 shows a schematic depiction of a remote-controlled mechanism 1 in a perspective view. The remote-controlled mechanism 1 comprises a housing 2, produced from an electrically insulating material such as e.g. plastic, having a front side 4, a mounting side 5, which is opposite the front side 4, and narrow sides 6 and wide sides 7 that connect the front and mounting sides 4 and 5. The front side 4 has an actuating element 3, also referred to simply as a handle, arranged on it that can be coupled to an actuating element 103 of a protective switching device 100, see FIG. 2, via a handle connector 8 in order to be able to actuate, i.e. switch on and off, the protective switching device 100—in the coupled state—using the remote-controlled mechanism 1. The remote-controlled mechanism 1 can be mounted by way of its mounting side 5 on a supporting or top-hat rail, not shown in FIG. 1, as is customary for equipment mounting in electrical installation distributors.

For the purpose of mechanical connection to a protective switching device 100, the remote-controlled mechanism 1 further comprises two connecting links 9, which are fixed to the front side 4 in the region of the wide side 7 and can be inserted into corresponding receptacles 109, formed on a front side of a housing 102 of the protective switching device 100, in order to mechanically connect the remote-controlled mechanism 1 to the protective switching device 100.

On its front side 4, the remote-controlled mechanism 1 has a mode selector switch 65 that can be put into three different operating positions:

"OFF" position: the remote-controlled mechanism 1 is switched off and the actuating element 3 is mechanically locked and can be sealed and/or closed off.

"RC OFF" position: no remote actuation, but only manual actuation of the remote-controlled mechanism 1 is possible and a reset is performed for the software of the remote-controlled mechanism 1. The software of the remote-controlled mechanism 1 can also be realized as firmware.

"RC ON" position: both manual and remote actuation of the remote-controlled mechanism 1 are possible.

The left-hand wide side 7 of the housing 2 has a circular opening in it, from which the tip of a driving shaft 61 protrudes, which can be coupled to a protective switching device 100.

Figure 2:
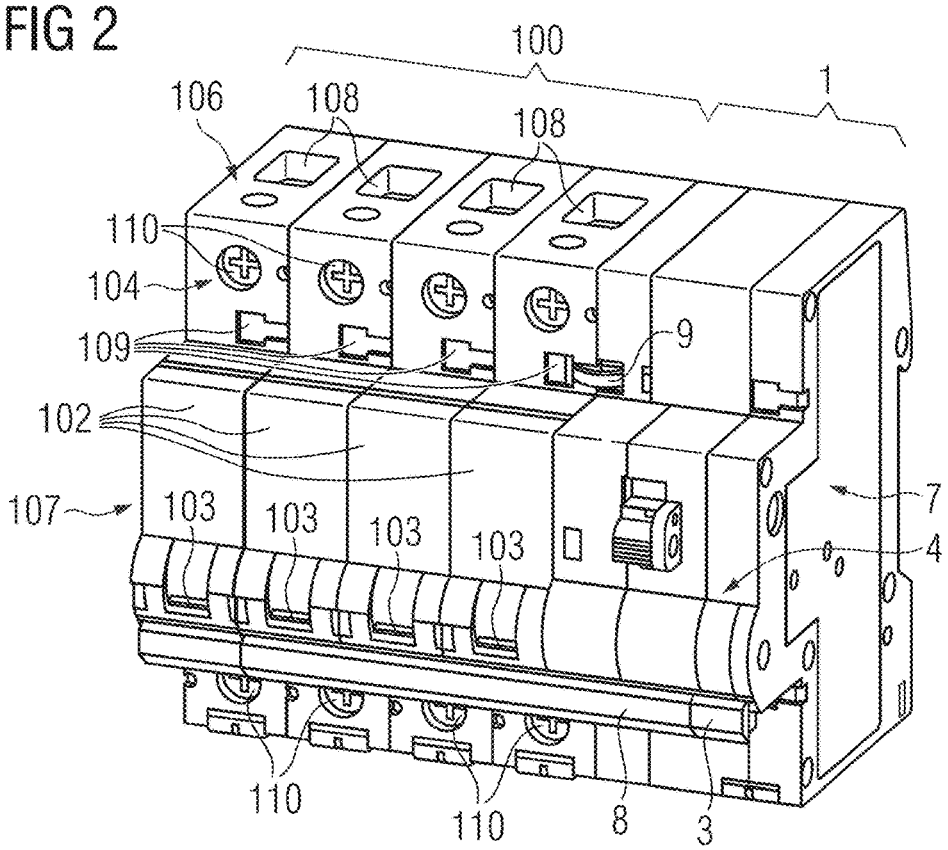
FIG. 2 shows a schematic depiction of a remote-controlled mechanism coupled to a protective switching device.

FIG. 2 schematically shows an equipment arrangement, including the remote-controlled mechanism 1 and a protective switching device 100 coupled thereto, in a perspective view. In the depiction in FIG. 2, the protective switching device 100 is of four-pole design. This is not essential to the invention, however, and should therefore be understood only by way of illustration; according to an embodiment of the invention, the remote-controlled mechanism 1 can be coupled either to a one-pole or to various multi-pole, e.g. 2-, 3-, 4- or n-pole ($n \in N$ with $n \geq 5$), protective switching devices 100. Only the handle connector 8 to be used needs to be matched to the width—and possibly to the type—of the respective protective switching device 100 to be coupled. Possible protective switching devices 100 in this case are residual current operated circuit breakers (RCCB), miniature circuit breakers (MCB), or else combined devices such as a residual current operated circuit breaker with overcurrent protection, which combines the functionality of a residual current operated circuit breaker (RCCB) with the functionality of a miniature circuit breaker (MCB) and possibly extends it by further functionalities, for example by that of an arc fault detection device.

To mechanically couple the remote-controlled mechanism 1 to the protective switching device 100, the two pieces of equipment are arranged such that their wide sides 7, 107 are facing one another. To secure the two pieces of equipment to one another, the two connecting links 9 of the remote-controlled mechanism 1 are now inserted into respective receptacles 109 that are arranged on the front side 104 of the protective switching device 100 so as to correspond to their positions. In addition, the functional coupling between the actuating element 3 of the remote-controlled mechanism 1 and the actuating element 103 of the protective switching device 100 that is produced via the common handle connector 8 acts as additional mechanical coupling, with the result that a robust mechanical connection between the two pieces of equipment 1, 100 is achieved. The type of mechanical connection between the remote-controlled mechanism 1 and the protective switching device 100 is not essential to the invention, however. This mechanical connection can therefore also be produced using alternative connecting devices such as rivets, screws, pins, clips, etc.

The protective switching device 100 comprises multiple openings 108 in the region of its narrow sides 106. Each of the openings is used for inserting an electrical connecting line, i.e. a phase line P1, P2, P3 or the neutral conductor N, see FIG. 5, in order to connect the protective switching device 100 to the electrical circuit that is to be protected. To this end, each opening 108 has a screw terminal arranged behind it that can be actuated using a clamping screw 110 accessible via a front side 104, in order to clamp or release the respective connecting line. The invention is not limited to this connection technique, however; it should be understood merely by way of illustration. Alternative connection techniques, for example a plug-in technique using screwless terminals, can likewise be used.

Figure 3:
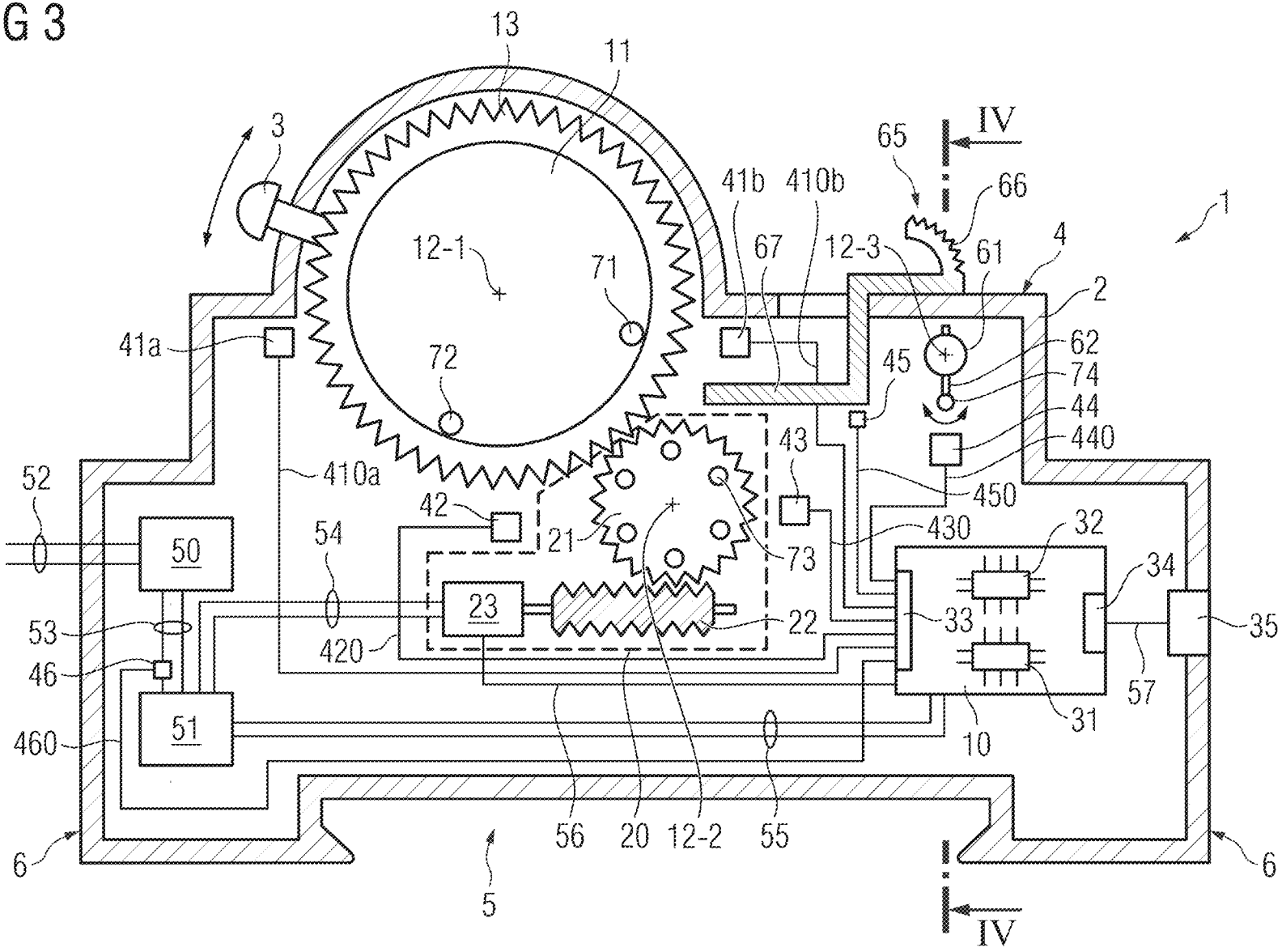
FIG. 3 shows a schematic depiction of the conceptual design of the remote-controlled mechanism.

FIG. 3 schematically shows the conceptual design of the remote-controlled mechanism 1 according to an embodiment of the invention in a section parallel to the wide sides 7. The remote-controlled mechanism 1 has a drive device 20 for remotely actuating the actuating element 3. To this end, the actuating element 3 is arranged so as to project from a handle cylinder 11, which means that actuation of the actuating element 3 results in the handle cylinder 11 being rotated about its axis of rotation 12-1. In the example shown, the drive device 20 comprises not only an electric motor 23, which can draw electrical energy from an energy store 51 via an electrical line 54, but also a gear unit having a worm shaft 22, which is connected non-rotationally to the motor 23 via a shaft, and a cogwheel 21, which is in the form of a worm gear, can rotate about an axis of rotation 12-2 and in turn engages with a toothing 13 formed on the circumference of the handle cylinder 11. The gear unit can have more cogwheels or fewer cogwheels than shown in this example embodiment. The gear unit 13, 21, 22 can be used to increase the torque of the motor 23 in such a way that the torque required for actuating the protective switching device 100 coupled to the remote-controlled mechanism 1 is achieved. In addition, it is likewise possible to design the drive device 20 to be gearless: in that case, the motor 23 can be actuated in a speed-controlled manner and acts on the toothing 13 formed on the handle cylinder 11 directly, i.e. without a gear transmission comprising one or more transmission steps.

The energy store 51 is charged via an electrical line 53 by a power supply unit 50 that is connected via an electrical line 52 to an electrical supply grid, which is not shown in FIG. 3. The power supply unit 50 provides a supply voltage, the level of which can be measured by a sixth sensor 46, a voltage sensor. The voltage sensor 46 is connected via a sixth sensor line 460 to the sensor interface 33, from where the sensor signals obtained can be forwarded to the control unit 31 for evaluation; the sensor signals obtained can be used by the control unit 31 to establish the level of the supply voltage of the remote-controlled mechanism 1.

To actuate the drive device 20, the remote-controlled mechanism 1 has a printed circuit board 10 on which a data processing device is arranged that, according to the example embodiment shown in FIG. 3, comprises at least one control unit 31, e.g. in the form of a processor or a microcontroller, and a memory device 32. To transmit control commands from the control unit 31 to the motor 23, the printed circuit board 10 is connected to the motor 23 by a signal line 56.

Furthermore, the printed circuit board 10, which is supplied with electrical energy via a line 55 from the energy store 51, has a communication device 34 arranged on it that is connected via a communication line 57 to a communication interface 35 of the remote-controlled mechanism 1, which communication interface is accessible from the outside of the housing 2; the communication interface 35, also called interface, and the communication device 34 can be used to perform communication between the remote-controlled mechanism 1 and a communication partner of the remote-controlled mechanism 1, e.g. a PC, e.g. of an operator in situ or of a higher-level unit, for example a control center or control room, a parameterization device or a computer cloud, for the purpose of interchanging signals, commands and/or data.

To this end, the communication device 34 is electrically conductively connected to the control unit 31 by conductor tracks of the printed circuit board 10. This allows information to be interchanged between the control unit 31 and a communication partner of the remote-controlled mechanism 1, for example relating to the type of an error that has occurred in the remote-controlled mechanism 1. The communication device 34 is advantageously in wireless form. Suitable transmission standards are for example WLAN, ZigBee, Bluetooth or infrared; this is not essential to the invention, however. Wireless interfaces can be arranged directly on the printed circuit board 10; for wired transmission standards such as Industrial Ethernet, on the other hand, the connection option of the communication interface 35 in the region of the housing surface can be used.

The communication interface 35 can significantly simplify an installation of the remote-controlled mechanism 1, in particular a coupling to a higher-level system. In addition, the communication interface 35 allows input values to be input not directly on the remote-controlled mechanism 1, but rather using an editing device suitable for this purpose, which can be coupled to the communication device 34 and to the control unit 31 via the communication interface 35. Alternatively, it is also possible for input values to be input using a suitable user interface of software running on a computer of a higher-level unit such as a control center or a control room.

Furthermore, the printed circuit board 10 has a sensor interface 33 for receiving sensor signals that are received from sensors 41*a*, 41*b*, 42, 43, 44 arranged inside the housing 2 of the remote-controlled mechanism 1.

A first sensor pair 41, comprising two magnetic field sensors 41*a* and 41*b*, is arranged in the region of the handle cylinder 11, where they interact with a magnetic field of a first permanent magnet 71 arranged on the handle cylinder 11. The two magnetic field sensors 41*a*, 41*b* of the first sensor pair 41 are connected via first sensor lines 410*a*, 410*b* to the sensor interface 33, from where the sensor signals obtained are forwarded to the control unit 31 for evaluation; the sensor signals obtained can be used by the control unit 31 to establish whether the actuating element 3 arranged on the handle cylinder 11 is in an On or Off position.

A second magnetic field sensor 42 is likewise arranged in the region of the handle cylinder 11, where it interacts with a magnetic field of a second permanent magnet 72 arranged on the circumference of the handle cylinder 11. The second magnetic field sensor 42 is connected via a second sensor line 420 to the sensor interface 33, from where the sensor signals obtained are forwarded to the control unit 31 for evaluation; the sensor signals obtained can be used by the control unit to establish the exact position of the actuating element 3.

A third magnetic field sensor 43 is arranged in the region of the cogwheel 21 of the drive device 20, where it interacts with a magnetic field of six third permanent magnets 73 arranged over the circumference of the cogwheel 21. The third magnetic field sensor 43 is connected via a third sensor line 430 to the sensor interface 33, from where the sensor signals obtained are forwarded to the control unit 31 for evaluation; the sensor signals obtained can be used by the control unit 31 to establish an acceleration of the cogwheel 21 and to deduce therefrom how many poles a protective switching device 100 attached to the remote-controlled mechanism 1 comprises.

A fourth magnetic field sensor 44 is arranged in the region of a driving shaft 61, which extends transversely through the housing 2 of the remote-controlled mechanism and is mounted therein so as to be able to rotate about an axis of rotation 12-3, in which region the sensor interacts with a magnetic field of a fourth permanent magnet 74 arranged on a pin 62 that is connected non-rotationally to the driving shaft 61. The fourth magnetic field sensor 44 is connected via a fourth sensor line 440 to the sensor interface 33, from where the sensor signals obtained are forwarded to the control unit 31 for evaluation; the sensor signals obtained can be used by the control unit 31 to establish the rotational position of the driving shaft 61.

Although the use of a shared printed circuit board is advantageous on account of its modular design and the relatively low installation complexity resulting therefrom, it is not essential to the invention. It is likewise possible to electrically conductively connect the individual electronic components to one another without using a shared printed circuit board.

Additionally, as already mentioned in the description of FIG. 1, the remote-controlled mechanism 1 comprises a mode selector switch 65 mounted movably on the front side 4, which mode selector switch comprises a handle 66, which is accessible on the front side 4, and a locking element 67, which is connected to the handle 66 and can be moved by the handle 66, for mechanically locking the handle cylinder 11. Arranged in the region of the mode selector switch 65 is a fifth sensor 45, a position sensor, which can detect the position of the mode selector switch 65 ("OFF" position, "RC OFF" position or "RC ON" position), e.g. via a permanent magnet arranged on the locking element 67. The fifth sensor 45 is connected via a fifth sensor line 450 to the sensor interface 33, from where the sensor signals obtained are forwarded to the control unit 31 for evaluation; the sensor signals obtained can be used by the control unit 31 to establish the position of the mode selector switch 65: "OFF" position, "RC OFF" position or "RC ON" position.

The magnetic field sensors 41 to 46 interacting with permanent magnets can be in the form of Hall sensors.

Figure 4:
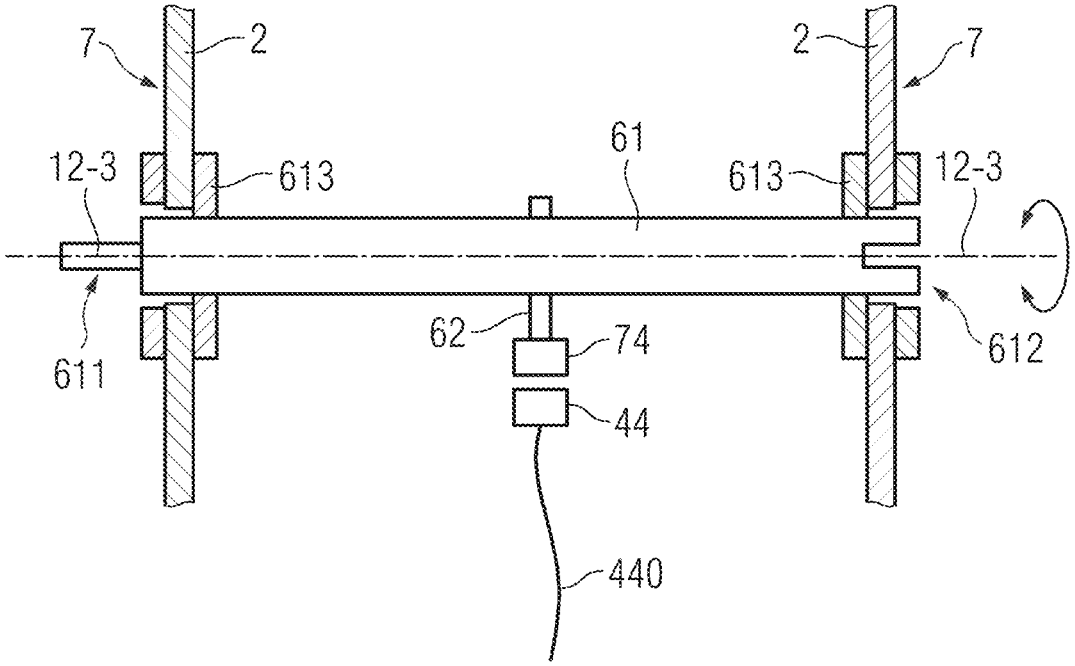
FIG. 4 shows a section through a remote-controlled mechanism.

FIG. 4 shows a section through the remote-controlled mechanism 1 shown in FIG. 3, the sectional plane IV running through the driving shaft 61 at right angles to the front side 4 of the remote-controlled mechanism 1. The driving shaft 61, which can rotate about an axis of rotation 12-3, bears the pin 62 connected non-rotationally to the driving shaft 61, the tip of which pin has the fourth permanent magnet 74 arranged on it. The fourth magnetic sensor 44, which is connected to the sensor interface 33 via the fourth sensor line 440, interacts with the magnetic field of the fourth permanent magnet 74. The driving shaft 61 is rotatably mounted in bearing bushes 613 arranged on the wide sides 7 of the housing 2. A driving arm 611 protruding from the housing wall 2 of the wide side 7 is mounted at one end of the driving shaft 61, and a driving bush 612 is mounted at the opposite end of the driving shaft 61.

Figure 5:
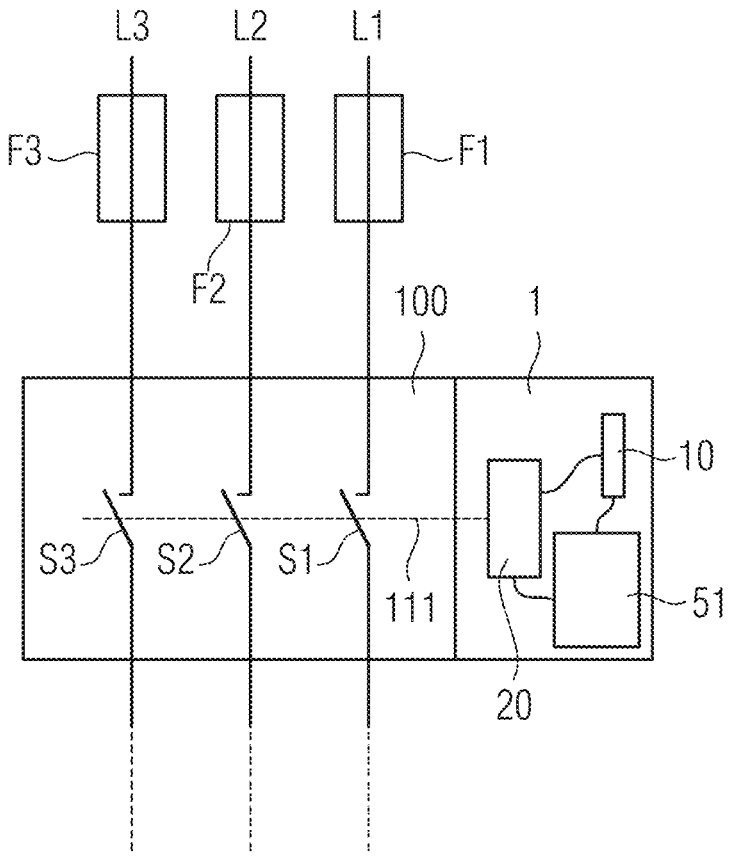
FIG. 5 shows an equivalent circuit diagram for a remote-controlled mechanism coupled to a protective switching device.

FIG. 5 shows an equivalent circuit diagram for a remote-controlled mechanism 1 coupled to a protective switching device 100. Three electrical connecting lines L1, L2 and L3 are connected to both the inputs and the outputs of the 3-pole protective switching device 100, each of the lines being associated with an electrical load circuit having a respectively associated electrical load F1, F2 or F3. Inside the protective switching device 100, the input and output connections of each of the three connecting lines L1, L2 and L3 are electrically conductively connected to one another by way of a current path running through the protective switching device 100. A switching contact S1, S2 and S3 that is directly and uniquely associated with the respective current path can be used to interrupt the current paths when required, i.e. if there is an appropriate situation, for example a short circuit, as a result of the switching contacts S1, S2 and S3 opening.

To actuate the three switching contacts S1, S2 and S3, the protective switching device 100 has a switching mechanism, not shown in more detail in FIG. 5, that is connected to the drive device 20 of the remote-controlled mechanism 1 by way of a mechanical operative connection 111. A control unit arranged on a printed circuit board 10 controls the operation of the drive device 20 by virtue of the control unit enabling or disabling a supply of electrical energy to the drive device 20 from an energy store 51. In this way, the three switching contacts S1, S2 and S3 can be opened using the remote-controlled mechanism 1 in order to interrupt the current paths associated with the three switching contacts S1, S2 and S3 and therefore to isolate the load circuits L1, L2 and L3 from the electrical conductor system. Similarly, the switching contacts S1, S2 and S3 can be closed again using the remote-controlled mechanism 1 in order to restore a supply of power to the previously interrupted load circuits L1, L2 and L3.

Figure 6:
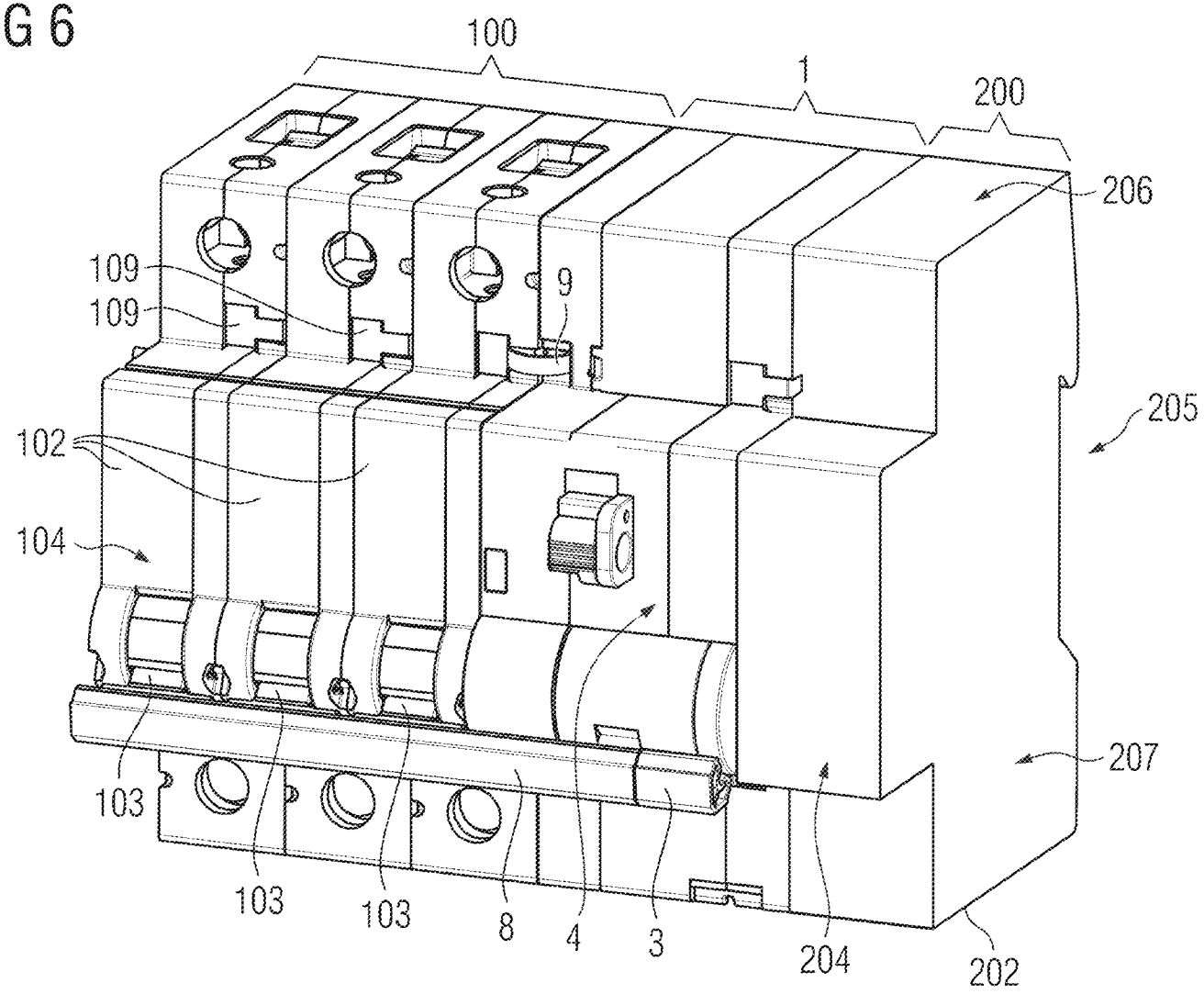
FIG. 6 shows a schematic depiction of a remote-controlled mechanism that is coupled both to a protective switching device and to a supplementary device.

FIG. 6 shows a depiction of a remote-controlled mechanism 1, which is coupled both to a protective switching device 100 and to a supplementary device 200, as a further example embodiment. The combination of the remote-controlled mechanism 1 with the protective switching device 100, which is arranged on the left-hand side of the remote-controlled mechanism 1 when looking at the front side 4 of the remote-controlled mechanism 1, essentially corresponds to the equipment arrangement shown in FIG. 2. The supplementary device 200 arranged on the accordingly right-hand side of the remote-controlled mechanism 1 comprises a housing 202, produced from an electrically insulating material, having a front side 204, a mounting side 205, which is opposite the front side 204, and having narrow sides 206 and wide sides 207 that connect the front and mounting sides 204 and 205. Like the remote-controlled mechanism 1 and the protective switching device 100, the supplementary device 200 can be mounted by way of its mounting side 205 on a supporting or top-hat rail. The supplementary device 200 can be a shunt release, e.g. an undervoltage or overvoltage release.

Figure 7:
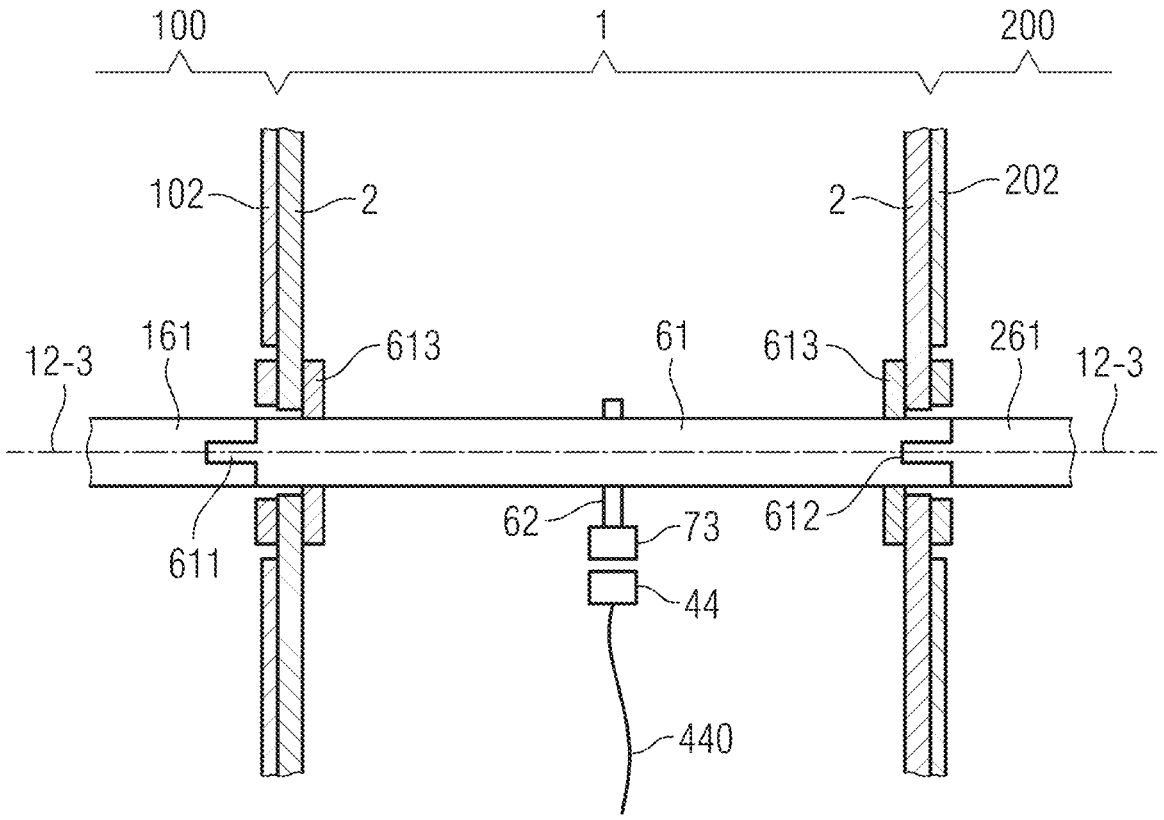
FIG. 7 shows a section through an equipment arrangement as shown in FIG. 6.

FIG. 7 shows a section through the equipment arrangement 1, 100, 200 shown in FIG. 6, which comprises the remote-controlled mechanism 1, the protective switching device 100 and the supplementary device 200, with the sectional plane running through the driving shaft 61 of the remote-controlled mechanism 1 at right angles to the front side 4 of the remote-controlled mechanism 1. The rotatably mounted driving shaft 61 bears a pin 62 connected non-rotationally to the driving shaft 61, the tip of which pin has the fourth permanent magnet 74 arranged on it. The fourth magnetic sensor 44, which is connected to the sensor interface 33 via a fourth sensor line 440, interacts with the magnetic field of the fourth permanent magnet 74. The driving shaft 61 is rotatably mounted in bearing bushes 613 arranged on the wide sides 7 of the housing 2 of the remote-controlled mechanism 1. A driving arm 611 is mounted at one end of the driving shaft 61, and a driving bush 612 is mounted at the opposite end of the driving shaft 61.

The driving arm 611 of the driving shaft 61 of the remote-controlled mechanism 1 connects the driving shaft 61 of the remote-controlled mechanism 1 non-rotationally to a driving shaft 161 of the protective switching device 100. The driving bush 612 of the driving shaft 61 of the remote-controlled mechanism 1 connects the driving shaft 61 of the remote-controlled mechanism 1 non-rotationally to a driving shaft 261 of the supplementary device 200. A rotation of the driving shaft 261 of the supplementary device 200 about its longitudinal axis, which coincides with the longitudinal axis 12-3 of the driving shaft 61 of the remote-controlled mechanism 1, which rotation is triggered in the supplementary device 200, e.g. based upon an overvoltage detected by the supplementary device 200, can therefore be transmitted to the driving shaft 161 of the protective switching device 100 by way of the driving shaft 61 of the remote-controlled mechanism 1. In the protective switching device 100, the rotation of the driving shaft 161 of the protective switching device 100 leads to tripping of the protective switching device 100, i.e. interruption of a circuit that is endangered by the overvoltage.

Figure 8:
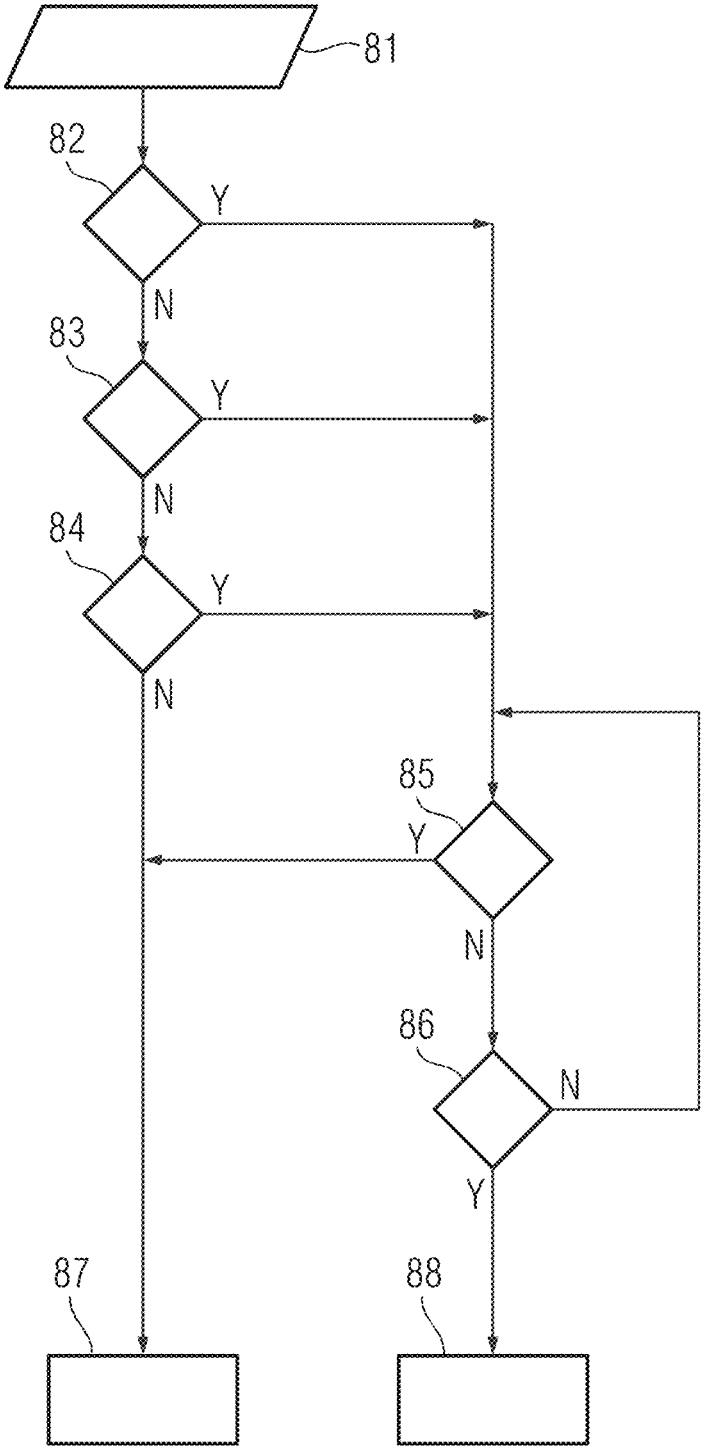
FIG. 8 shows a schematic depiction of the method according to an embodiment of the invention.

FIG. 8 shows a flowchart. It is a graphical representation relating to the implementation of an example embodiment of the method according to the invention in a program or algorithm. If the equipment arrangement 1, 100, 200, which comprises the remote-controlled mechanism 1, the protective switching device 100 and the supplementary device 200, is in a switched-off state, i.e. the switches S1, S2, S3 in the protective switching device 100 are in a nonconductive state, and the remote-controlled mechanism 1, to be more precise the control unit 31, receives 81 an electromagnetic signal that is a command to switch on the remote-controlled mechanism 1 remotely (remote actuation), a check 82 is first of all performed to determine whether the equipment arrangement 1, 100, 200 has been put into the switched-off state by an operator manually in situ.

The check 82 to determine whether the equipment arrangement 1, 100, 200 has been put into the switched-off state ("manual-off") by an operator manually in situ comprises the following checking steps 82-1, 82-2 and 82-3:

Checking step 82-1: the control unit 31 takes signals from the sensors 41*a*, 41*b* and 42 as a basis for verifying that the control element 3 is in the Off position (handle 3 and handle connector 8 are in the Off position, e.g. point downward).

Checking step 82-2: the control unit 31 verifies that there is no indication in the memory device 32 that the drive device 20 was in operation during the movement of the control element 3 to the Off position: there is no actuation command for the motor 23, nor has the sensor 43 detected a rotation of the worm gear 21.

Checking step 82-3: the control unit 31 verifies that there is no indication in the memory device 32 that a rotation of the driving shaft 61 has occurred, brought about by a breaking operation on the protective switching device 1 that was triggered by the supplementary device 200, during the movement of the control element 3 to the Off position: the sensor 44 has detected no rotation of the driving shaft 61.

If all three checking steps 82-1, 82-2 and 82-3 lead to a positive result, the equipment arrangement must have been put into the switched-off state by an operator manually in situ.

If this is not the case ("N" for "No"), the program sequence moves via the arrow "N" leaving the branch point 82 to a check 83 to determine whether the mode selector switch 65 is in the "OFF" position, in which it prevents actuation of the actuating element 3, or in the "RC OFF" position, in which a reset is performed for the software of the remote-controlled mechanism 1. This check can be performed e.g. by testing the fifth sensor 45 shown in FIG. 3, which detects the position of the mode selector switch 65—"OFF" position, "RC OFF" position or "RC ON" position—and reports it to the control unit 31.

If this is not the case ("N" for "No"), i.e. if the mode selector switch 65 is in the "RC ON" position, the program sequence moves via the arrow "N" leaving the branch point 83 to a check 84 to determine whether the remote-controlled mechanism 1 has been put into operation again; this check can be performed e.g. by testing the supply voltage, provided by the power supply unit 50, on the remote-controlled mechanism 1 by using the voltage sensor 46 shown in FIG. 3, which measures the supply voltage of the remote-controlled mechanism 1 and reports it to the control unit 31.

It is also possible for the time characteristic of the supply voltage on the remote-controlled mechanism 1 to be sensed using the voltage sensor 46 and for these measured values to be stored in the memory device 32 as a time series. If the control unit 31 detects a rise in the supply voltage from a value in the region of 0 V to the present voltage level, the system has been put into operation again.

If the result of the check 84 is that the remote-controlled mechanism 1 has not been put into operation again ("N" for "No"), the program sequence moves via the arrow "N" leaving the branch point 84 to the operation 87, in which the command to switch on the remote-controlled mechanism 1 and hence the protective switching device 100 coupled to the remote-controlled mechanism 1 is executed; this is done by activating the drive device 20, with the result that the actuating element 3 and hence the handle bridge 8, shown in FIG. 6, of the equipment 1 and 100 are moved to the ON position.

If one of the checks 82, 83 and 84 has a positive outcome ("Y" for "Yes"), the program sequence moves via the arrows "Y" leaving the branch points 82, 83, 84 to a check 85 to determine whether the inventive "drive device disablement" safety function, also called "manual-on" function below, defined by the method has been temporarily overridden (reset function): it is supposed to be possible for an operator to remotely (=remote operator) temporarily override the "manual-on" function, which disables the drive device, since there may be instances of application in which the remote-controlled mechanism 1 cannot distinguish an automatic breaking operation on the equipment 1 and 100, e.g. by way of a shunt release 200 attached to the remote-controlled mechanism 1, from a breaking operation on the equipment 1 and 100 by an operator manually in situ via the handle bridge 8, and therefore incorrectly indicates to the remote operator that the equipment arrangement 1, 100, 200 has been put into the switched-off state by an operator manually in situ—in that case, the device arrangement 1, 100, 200 could be put into operation again only by an operator in situ. If the remote operator knows that this must be an incorrect report, because an operator in situ can be ruled out definitively, e.g. in the case of remote-controlled mechanisms arranged in hard-to-reach places, such as on offshore wind farms, the remote operator has the opportunity to use a reset function to briefly override the "manual-on" function.

If the result of the check 85 is that the "manual-on" function has been briefly overridden using the reset function ("Y" for "Yes"), then the program sequence moves via the arrow "Y" leaving the branch point 85 to the operation 87, in which the command to switch on the remote-controlled mechanism 1 and hence the protective switching device 100 coupled to the remote-controlled mechanism 1 is executed.

If the result of the check 85 is that the "manual-on" function has not been briefly overridden using the reset function ("N" for "No"), then the program sequence moves via the arrow "N" leaving the branch point 85 to a check 86 to determine whether the equipment 1 and 100 has since been switched on by an operator manually in situ via the handle bridge 8. To this end, the control unit 31 can take signals from the sensors 41*a*, 41*b* and 42 as a basis for verifying that the control element 3 is in the ON position, e.g. handle 3 and handle connector 8 point upward.

If the result of the check 86 is that the equipment 1 and 100 has not since been switched on by an operator manually in situ via the handle bridge 8, then the program sequence moves via the arrow "N" leaving the branch point 85 (wait loop) to the check 85 again.

If the result of the check 86 is that the equipment 1 and 100 has since been switched on by an operator manually in situ via the handle bridge 8, then the program sequence moves via the arrow "Y" leaving the branch point 86 to the operation 88, in which the remotely received command 81 to switch on the remote-controlled mechanism 1 and hence the protective switching device 100 coupled to the remote-controlled mechanism 1 is rejected as obsolete.

Of course, the embodiments of the method according to the invention and the imaging apparatus according to the invention described here should be understood as being example. Therefore, individual embodiments may be expanded by features of other embodiments. In particular, the sequence of the method steps of the method according to the invention should be understood as being example. The individual steps can also be performed in a different order or overlap partially or completely in terms of time.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A remote-controlled mechanism configured to be coupled to a protective switching device to use the remote-controlled mechanism to actuate the coupled protective switching device, the remote-controlled mechanism comprising:

an actuating element, operatively connectable to an actuating element of the coupled protective switching device, manually actuatable or actuatable by a remotely controllable drive device of the remote-controlled mechanism;

one or more first sensor devices configured to capture position data relating to a position of the actuating element of the remote-controlled mechanism;

a controller configured to evaluate the position data captured and to control the remotely controllable drive device via control commands;

a driving shaft configured to mechanically transmit a tripping movement; and a second sensor device configured to sense a movement of the driving shaft, wherein the controller is configured to disable the remotely controllable drive device upon an evaluation of at least one of the position data or the control commands revealing that the actuating element of the remote-controlled mechanism has been manually switched off.

2. The remote-controlled mechanism of claim 1, wherein the controller is configured to cancel a disablement of the remotely controllable drive device for a period of time after the controller has received a signal from a higher-level unit of the remote-controlled mechanism.

3. The remote-controlled mechanism of claim 2, wherein the first sensor device is configured to sense a movement of the remotely controllable drive device.

4. The remote-controlled mechanism of claim 1, wherein the first sensor device is configured to sense a movement of the remotely controllable drive device.

5. The remote-controlled mechanism of claim 1, further comprising:

a voltage sensor configured to measure a level of a supply voltage of the remote-controlled mechanism.

6. An equipment arrangement, comprising:

the remote-controlled mechanism of claim 1; and the protective switching device coupled to the remote-controlled mechanism.

7. An equipment arrangement of comprising:

a protective switching device;

a remote-controlled mechanism configured to be coupled to the protective switching device to use the remote-controlled mechanism to actuate the coupled protective switching device, the remote-controlled mechanism including an actuating element, operatively connectable to an actuating element of the coupled protective switching device, manually actuatable or actuatable by a remotely controllable drive device of the remote-controlled mechanism, one or more sensor devices configured to capture position data relating to a position of the actuating element of the remote-controlled mechanism, a controller configured to evaluate the position data captured and to control the remotely controllable drive device via control commands, and a driving shaft; and a supplementary device coupled to the remote-controlled mechanism, wherein the controller is configured to disable the remotely controllable drive device upon an evaluation of at least one of the position data or the control commands revealing that the actuating element of the remote-controlled mechanism has been manually switched off, and wherein the driving shaft is configured to transmit a tripping movement initiated by the supplementary device to the protective switching device, mechanically.

8. A method for switching on a protective switching device coupled to a remote-controlled mechanism, the remote-controlled mechanism including an actuating element operatively connected to an actuating element of the protective switching device, the actuating element of the protective switching device being actuatable to switch on the protective switching device and being manually actuatable or actuatable by a remotely controllable drive device of the remote-controlled mechanism, the method comprising:

disabling the remotely controllable drive device upon an evaluation of at least one of position data describing a position of the actuating element of the remote-controlled mechanism, or control commands relating to operation of the remotely controllable drive device revealing that the actuating element of the remote-controlled mechanism has been manually switched off;

mechanically transmitting, via a driving shaft, a tripping movement; and sensing, via a sensor device, a movement of the driving shaft.

9. The method of claim 8, wherein the disabling the remotely controllable drive device is cancelled for a period of time after the remote-controlled mechanism has received a signal from a higher-level unit of the remote-controlled mechanism.

10. The method of claim 9, further comprising:

disabling the remotely controllable drive device after a reset has been performed for the remote-controlled mechanism that puts the remote-controlled mechanism into a defined initial state.

11. The method of claim 9, further comprising:

disabling the drive device upon the remote-controlled mechanism being put into operation by applying a supply voltage.

12. A non-transitory computer program product storing software code sections, directly loadable into an internal memory of a digital computer, to carry out the method of claim 9 when the software code sections run on the computer.

13. The method of claim 8, further comprising:

disabling the remotely controllable drive device after a reset has been performed for the remote-controlled mechanism that puts the remote-controlled mechanism into an initial state.

14. A non-transitory computer program product storing software code sections, directly loadable into an internal memory of a digital computer, to carry out the method of claim 13 when the software code sections run on the computer.

15. The method of claim 8, further comprising:

disabling the drive device upon the remote-controlled mechanism being put into operation by applying a supply voltage.

16. A non-transitory computer program product storing software code sections, directly loadable into an internal memory of a digital computer, to carry out the method of claim 15 when the software code sections run on the computer.

17. A non-transitory computer program product storing software code sections, directly loadable into an internal memory of a digital computer, to carry out the method of claim 8 when the software code sections run on the computer.

* * * * *